US007296632B2

(12) United States Patent
Barker et al.

(10) Patent No.: US 7,296,632 B2
(45) Date of Patent: Nov. 20, 2007

(54) CASING ALIGNMENT TOOL

(75) Inventors: Stewart John Barker, Aberdeen (GB); Neil Gordon, Aberdeen (GB)

(73) Assignee: BJ Services Company, Houston, TX (US)

( * ) Notice: Subject to any disclaimer, the term of this patent is extended or adjusted under 35 U.S.C. 154(b) by 258 days.

(21) Appl. No.: 11/103,132

(22) Filed: Apr. 11, 2005

(65) Prior Publication Data

US 2006/0108124 A1 May 25, 2006

(30) Foreign Application Priority Data

Nov. 24, 2004 (GB) ..... 0425841

(51) Int. Cl.
*E21B 19/16* (2006.01)

(52) U.S. Cl. ..... 166/380; 166/77.1; 166/85.1

(58) Field of Classification Search ..... 166/379, 166/380, 77.1, 85.1, 85.5
See application file for complete search history.

(56) References Cited

U.S. PATENT DOCUMENTS

| | | | | |
|---|---|---|---|---|
| 2,005 | A | 3/1841 | Shepherd et al. | |
| 3,976,207 | A | 8/1976 | Schultz | 214/2.5 |
| 4,440,220 | A | 4/1984 | McArthur | 166/85 |
| 4,625,796 | A | 12/1986 | Boyadjieff | 166/77.5 |
| 4,652,195 | A | 3/1987 | McArthur | 414/22 |
| 4,921,386 | A | 5/1990 | McArthur | 414/22.51 |
| 5,049,020 | A | 9/1991 | McArthur | 414/22.51 |
| 5,062,756 | A | 11/1991 | McArthur et al. | 414/22.51 |
| 5,125,148 | A | 6/1992 | Krasnov | 29/426.6 |
| 5,609,457 | A | 3/1997 | Burns | 414/22.51 |
| 6,161,617 | A | 12/2000 | Gjedebo | 166/77.52 |
| 2004/0049905 | A1 | 3/2004 | Jansch et al. | 29/428 |
| 2004/0149451 | A1 | 8/2004 | Pietras | 166/380 |

FOREIGN PATENT DOCUMENTS

| | | |
|---|---|---|
| CA | 2140203 | 9/1995 |
| EP | 0 479 583 | 4/1992 |
| WO | WO 99/30000 | 6/1999 |
| WO | WO99/30000 | 6/1999 |
| WO | WO 00/52297 | 9/2000 |

OTHER PUBLICATIONS http://www.frankscasing.com/products/specialized/guardian/stabrite/; Frank's Casing Crew & Rental Tools, Inc.; "Safe & Accurate Pipe Alignment;" printed Nov. 18, 2004; 1 pg.

(Continued)

*Primary Examiner*—William P Neuder
(74) *Attorney, Agent, or Firm*—Howrey LLP

(57) ABSTRACT

An alignment apparatus for use with the assembly of tubular segments with a tubular string in a well bore is disclosed. The alignment apparatus includes an actuator assembly functionally associated with an engagement assembly. Upon actuation of the actuator assembly, the engagement assembly engages the segment. The alignment apparatus is then lowered such that the segment contacts the string, and a connection may be made. A method of improving the alignment of the segment with the tubular string in the well bore is also is also disclosed.

25 Claims, 7 Drawing Sheets

OTHER PUBLICATIONS http://www.bvmcorp.com/elev/sje.html; BVM Single Joint Elevator; "BVM's Single Joint Elevator;" printed Nov. 18, 2004; 2 pgs.

"Combined Search and Examination Report Under Sections 17 and 18(3)", Mailed Jun. 28, 2005 by the Patent Office of the United Kingdom for British Patent Application No. GB0425841.4 (5 pages total).

European Search Report dated Mar. 3, 2006.

GB Search Report dated Sep. 20, 2006.

EP Examination Report dated Feb. 7, 2007. (EP Application Serial No. 05077652.5, filed Nov. 22, 2005).

GB Examination Report dated Feb. 16, 2007 (GB Application Serial No. 0425841.4, filed Nov. 24, 2004).

CASING ALIGNMENT TOOL

CROSS-REFERENCE TO RELATED APPLICATION

This application is the U.S. counterpart of United Kingdom patent application Serial Number 0425841.4, filed Nov. 24, 2004, by BJ Services Company, entitled "Casing Alignment Tool," inventors Barker and Gordon, incorporated by reference in its entity herein, and to which this application claims priority.

BACKGROUND OF THE INVENTION

1. Field of the Invention

The present invention relates to the drilling and completion of well bores in the field of oil and gas recovery. More particularly, this invention relates to an apparatus adapted to improve the alignment of a tubular segments, such as a casing joint or production tubing segment, e.g.) with the tubular string below (e.g. casing string, production string, and the like) extending within a well bore.

2. Description of the Related Art

In the oil and gas industry, well bores are typically drilled by rotating a drill string comprising a plurality of drill pipe segments serially connected and rotating a drill bit thereby creating the well bore. Once the well bore is drilled, tubular casing may be placed in the well bore to protect the well bore from damage over time. The well may then be cemented as desired. Once the casing is in place, production pipe or tubing may also be run within the casing string in the well bore. Such systems may be utilized on land or off-shore.

To assemble the casing string in prior art systems, a derrick or rig is constructed above the well bore. A top drive assembly or drive block may be provided, which may be used to hoist the individual segments above surface. These tubular segments typically are threaded on each end.

An upper portion of the string is extended out of the well bore (i.e. above surface) by a spider having slips on the rig or derrick floor, for example. The slips are adapted to selectively engage the tubular string to prevent the string from falling into the well bore. The tubular string may plurality of segments serially connected end-to-end, described above. The tubular string is located within the well bore W. The upper end of the tubular string is connectable to the lower end of the next segment to be connected. The top drive selectively lowers the segments into contact with the string in the well bore.

In some prior art methods, an operator (a "stabber") stands on a stabbing board located on the rig above surface. A segment is hoisted off surface via the top drive assembly, and the stabber attempts to align the lower end of the tubular segment extending vertically from the rig or derrick with the string in the well bore below. This may prove to be difficult, as the segments tend to sway, being typically approximately 40 feet long and four to twenty inches in diameter hanging from the top drive assembly.

Once stabber has substantially aligned the tubular segment to be run with the string in the well bore, the segment may be connected to the string. For example, each end of the segments may be threaded. Thus, once the threads of the tubular segment to be run substantially align with the threads on the segment extending above surface from the drill sting, the segment may be rotated utilizing hydraulic tongs. Or the top drive assembly used to rotate the drill string may be utilized to rotate the segment until it is connected to the string. Other conventional connection methods known to one of ordinary skill in the art may further be utilized, such a snap fit, etc.

Alignment of each tubular segment (casing segment or production pipe segment, e.g.) is important for numerous reasons. The tubular segments typically may be forty feet in length, and from two inches to four and a half inches in diameter. Slight misalignment of the segment and the string may weaken the resulting casing string, for example. Greater misalignment of the tubular segment being run and the string in the well bore may compromise the seal between casing segments. If misalignment is significant, cross-threading may occur. The misalignment problem is exacerbated in relatively deep wells, in which the tubing will experience excessive pounds pressure and excessive heat, thus further acting to weaken the seal.

Numerous attempts to improve the alignment of the tubular segments with the string in the well bore during assembly are known. For example, U.S. Pat. No. 4,681,158 to Pennison, incorporated by reference in its entirety herein, for background material, describes the PenniYoke system that includes a casing alignment tool having arms with rollers which selectively clamp end of the casing segment near the well bore (i.e. the lower end of the segment). Once clamped, the hydraulic tongs rotate the segment, the rollers allowing the segment to rotate within the arms. Once the connection is made, the yoke is pivoted away from the string, while another section or segment is hoisted. Similar systems are described in U.S. Pat. No. 5,062,756 to McArthur and U.S. Pat. No. 5,609,457 to Burns.

It has been determined that the use of relatively-complicated systems overhead of workers at surface may be undesirable in some circumstances. Relatively-complicated machinery may increase the cost of the alignment of the tubular segment, and may lead to additional downtime due to the malfunction of complex equipment, increases in the time and cost of transporting the complex equipment to the well site, etc.

Thus, there is a need for an apparatus for improving the alignment of tubular segments with a tubular string in the well bore. It is desirable to provide an alignment tool, which is relatively simple and inexpensive, compared to alternative systems. It is desirable that such a tool substantially align a tubular segment with a string in the well bore with minimal manual intervention. Preferably, the system is simple and easy to operate, and less expensive than present systems. Such a system advantageously would similarly improved ether safety of the alignment operation. Further, the tool would preferably be useable with prior art hydraulic tong systems.

Embodiments of the present invention are directed at overcoming, or reducing and minimizing the effects of, any shortcomings associated with the prior art.

SUMMARY OF THE INVENTION

The invention relates to a tool for aligning a tubular joint to be run suspended from a top drive assembly with a tubular string in a well bore. An upper linear actuator assembly having a central body connectable to the top drive assembly and being within in a sleeve adapted to be selectively movable relative to the central body upon actuation is described. The tool may include a lower actuation assembly having an upper end connectable to the central body of the actuator assembly and a stinger adapted to selectively engage the segment. Upon actuation of the upper actuator assembly, the stinger engages the segment thereby substantially aligning the segment with the string below. No threaded connection to the tubular segment is required.

In some embodiments, an apparatus is described for aligning a tubular segment with a tubular string in a well bore. The apparatus may include (1) an actuator assembly having a first member adapted to be selectively movable relative to a second member upon actuation; and (2) an engagement assembly being functionally associated with the acuator assembly. The engagement assembly may be adapted to selectively engage the segment, wherein upon actuation of the actuator assembly, the engagement assembly engages the segment to substantially align the segment with the string.

In some aspects, the actuator assembly includes a central body within a sleeve adapted to move relative to each other; in others, the actuator assembly includes a central screw within a solid sleeve.

Also disclosed is a method of aligning a tubular segment with tubular string in a well bore, including the engagement assembly and actuator assembly discussed herein.

Thus, the apparatus may be used to eliminate the need for the stabbers and stabbing boards when running tubular strings (e.g. casing, production, or drill string) when the segment is being run.

For the purposes of this disclosure, while the term "casing segment" or "tubular segment" will be utilized in the description of various embodiments, it is understood that the invention is not so limited, as the "segments" may comprise drill pipe segments, casing segments, production pipe segments, and the like. Similarly, while the string is described as a casing string in some embodiments, the invention is not so limited, as the string may comprise a casing string, a drill string, production string, etc. Thus, the terms pipe strings, casing strings, and drill strings may be used interchangeably, as the present disclosure is adapted for use with a myriad of oil field strings, as would be realized by one of ordinarily skill in the art having the benefit of this disclosure.

Figure 1:
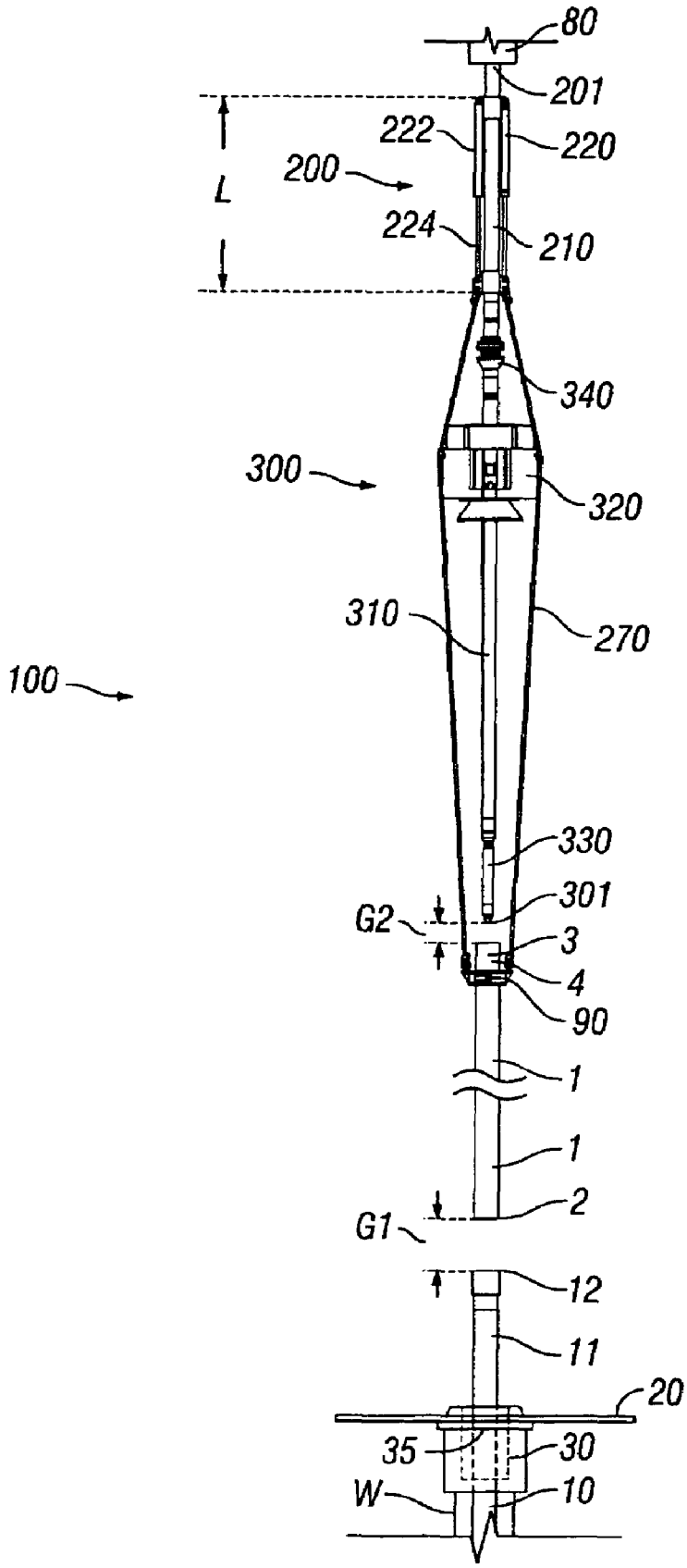
FIG. 1 shows an embodiment of an alignment apparatus connected to a generic top drive assembly and located above the tubular string in the well bore.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in the oil and gas recovery operation and in the completion of well bores. In the interest of clarity, not all features of an actual implementation are described in this specification. It will of course be appreciated that in the development of any such actual embodiment, numerous implementation-specific decisions must be made to achieve the developers' specific goals, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments of the invention will become apparent from consideration of the following description and drawings.

Embodiments of the invention will now be described with reference to the accompanying figures. Similar reference designators will be used to refer to corresponding elements in the different figures of the drawings.

Referring to FIG. 1, an alignment apparatus is shown depicting one illustrative embodiment of the present invention, for use in the assemblage of tubular strings, such as casing string, completing strings, e.g.

The tubular string 10 (e.g. casing string) is shown within the well bore W. A section 11 of the last segment of the tubular string extends above surface, and may comprise a collar 12. The tubular string 10 is suspended from the rig floor 20 by a conventional spider 30. Within the spider 30 are a plurality of radially-extendable slips 35, which operate to selectively secure the tubular string 10 from falling to the bottom of the well bore W. The spider 30 may be pneumatically, hydraulically, or manually actuated, as would be realized by one of ordinary skill in the art.

An embodiment of the alignment apparatus 100 of the present invention is shown above the tubular sting 10. In this embodiment, the apparatus 100 is shown suspended from a top drive assembly 80 of the prior art, and connected to the tubular segment 1 (e.g. casing joint) to be run by an upper connection 201. It is noted that while the embodiment of FIG. 1 is shown and described as being suspended from the top drive 80, the term top drive assembly is being utilized throughout this disclosure in its most generic form, and may comprise any general configuration capable of suspending the apparatus above surface and for providing relative vertical movement with surface, such as a drive block, hoist, etc.

The alignment apparatus 100 or tool in FIG. 1 is shown as comprising an actuator assembly 200 and an engagement assembly 300. The actuator assembly 200 May be directly or indirectly connected to the top drive assembly 80 by an upper connection 201, such as by pins and a collar, or any suitable methods as would be realized by one of ordinary skill in the art having the benefit of this disclosure.

The actuator assembly 200 may be comprised of a first member and a second member, the members being adapted to move relative to each other in the vertical plane. The first member may be a substantially solid central body 210 and the second member may comprise a sleeve 220 in some embodiments, the central body 210 being located with the sleeve 220. As shown in FIG. 1, the first member and the second member each have an initial length L; i.e. in the configuration of FIG. 1, the length of the first member is substantially equal to the length of the second member.

The length of the second member may be selectively changed in some embodiments, as described more fully hereinafter. For example, the second member may comprise a sleeve 220 having an upper arm 222 and lower arm 224. In some embodiments, the lower arm 224 is adapted to move upwardly within the upper arm 222 of the sleeve 220, thus shortening the overall length of the second member 220.

Any other configuration which acts to generate a relatively downward force on the engagement assembly 300 with respect to the segment 1 (i.e. relative upward force on the segment 1 with respect to the engagement assembly 300), known to one of ordinary skill in the art having the benefit of this disclosure, could be utilized, as discussed more fully hereinafter with respect to FIGS. 5A-5E.

In some embodiments, the actuation of the actuator assembly 200 causes the first member and second member to move relative to each other 24 inches, for example. In some embodiments, when the actuator assembly 200 is actuated, the lower arm 224 retracts within the upper arm 222 of the sleeve 220 so that the overall length of the sleeve is reduced up to 24 inches.

In some preferred embodiments, the actuator assembly 100 comprises an upper linear actuator assembly, which may actuated via hydraulic or pneumatic means. As stated above, the upper linear actuator assembly may comprise the central body 210 within sleeve 220.

As shown in FIG. 1, the actuator assembly 200 is connectable to an engagement assembly 300. In the embodiment shown in FIG. 1, the engagement assembly 300 is connected to first member of the actuator assembly 200, shown as central body 210 in this embodiment. In the embodiment shown, the actuator assembly 200 is located above the engagement assembly 300. The engagement assembly 300 in some embodiments includes a stinger 310, which is adapted to engage the segment 1 to be run as described hereinafter. The engagement assembly 300 may also comprise a main elevator 320, although not required. Also not required, but may be included in the engagement assembly 300 as shown in FIG. 1, are conventional components utilized when running casing, such as the mud saver valve 330 as part of the stinger 310, and the fillup and circulate tool 340 ("FAC Tool"). The engagement assembly 300 may further comprise additional components utilized in the running of casing string, production tubing string, etc. provided such components do not interfere with the operation of the alignment apparatus described hereinafter.

As shown in FIG. 1, the second member of the actuator assembly 200, such as sleeve 220, may be connected to the segment 1 to be run by a conventional sling 270. Sling 270 may be selectively connected to the segment 1 by a conventional Single Joint Elevator ("SJE") 90.

Operation of an embodiment of the present invention is described hereinafter. The top drive assembly 80, including the alignment apparatus 100, is positioned over the well bore W and the tubular string 10 therewithin, to facilitate the proper subsequent connection of a segment 1 with the tubular string 10.

Once at a desired positioned over the well bore W, the top drive assembly 80 is lowered to connect the actuator assembly 200 of the alignment apparatus 100 to the top drive assembly 80 of the rig via upper connection 201. The sling 270 is attached to the actuator assembly 200, such as on the lower end of the second member or sleeve 220 of the linear actuator assembly. The engagement assembly 300 is attached to the first member, such as a central body 210 within the sleeve 220.

A SJE 90 is then connected to the segment 1 to be run, such as at the collar 4 on the upper end 3 of the segment 1. Once the SJE 90 is attached, the top drive assembly 80 lifts the alignment apparatus 100 along with the segment 1. The top drive assembly 80 then lifts the segment 1 vertically to suspend segment 1 over the string 10, in a sequentially vertical line, as shown in FIG. 1. A gap G1 initially exists between the lower end 2 of the segment 1 to be run and the upper end 11 having collar 12 of the tubular string 10, extending above surface from the well bore W via clamping action of the spider 30. This gap G1 exists as per normally operating standards, depending on the length and diameter of the segment 1 to be run, etc.

Also as shown in FIG. 1, the sling 270 is dimensioned such that a gap G2 exists between the upper end 3 of the segment 1 being run and the lower end 301 of the engagement assembly 300. In this particular embodiment, the lower end 301 of the engagement assembly 300 is located on the lower end of the mud saver valve 330 on stinger 310. In some applications, gap G2 may comprise approximately 10 inches. Of course, in applications which do not utilize the mud saver valve 330, the lower end of engagement assembly 300 may reside elsewhere.

If the top drive assembly 80 were simply lowered at this point without he operation of the alignment tool as described hereinafter, proper alignment of the segment 1 with the string 10 is unlikely. For instance, it is noted that at this point, the segment 1 may sway or pivot about connection 201 due to the wind (surface applications) or current (off shore applications).

Returning to the operation of the alignment apparatus 100, next, the actuator assembly 200 is actuated to provide relative movement between the first member and second member. For example, a hydraulic or pneumatic motor may be adapted to actuate a linear actuator 210, to shorten the length of the second member, such as a sleeve 220, with respect to the first member, such as the central body 210. In some embodiments, the stroke of the linear actuator assembly may be approximately 2½ feet to 3 feet. Thus, the lower arm 224 of the sleeve 220 is withdrawn into the upper arm 222 of the sleeve. This configuration is shown in FIG. 2.

Figure 2:
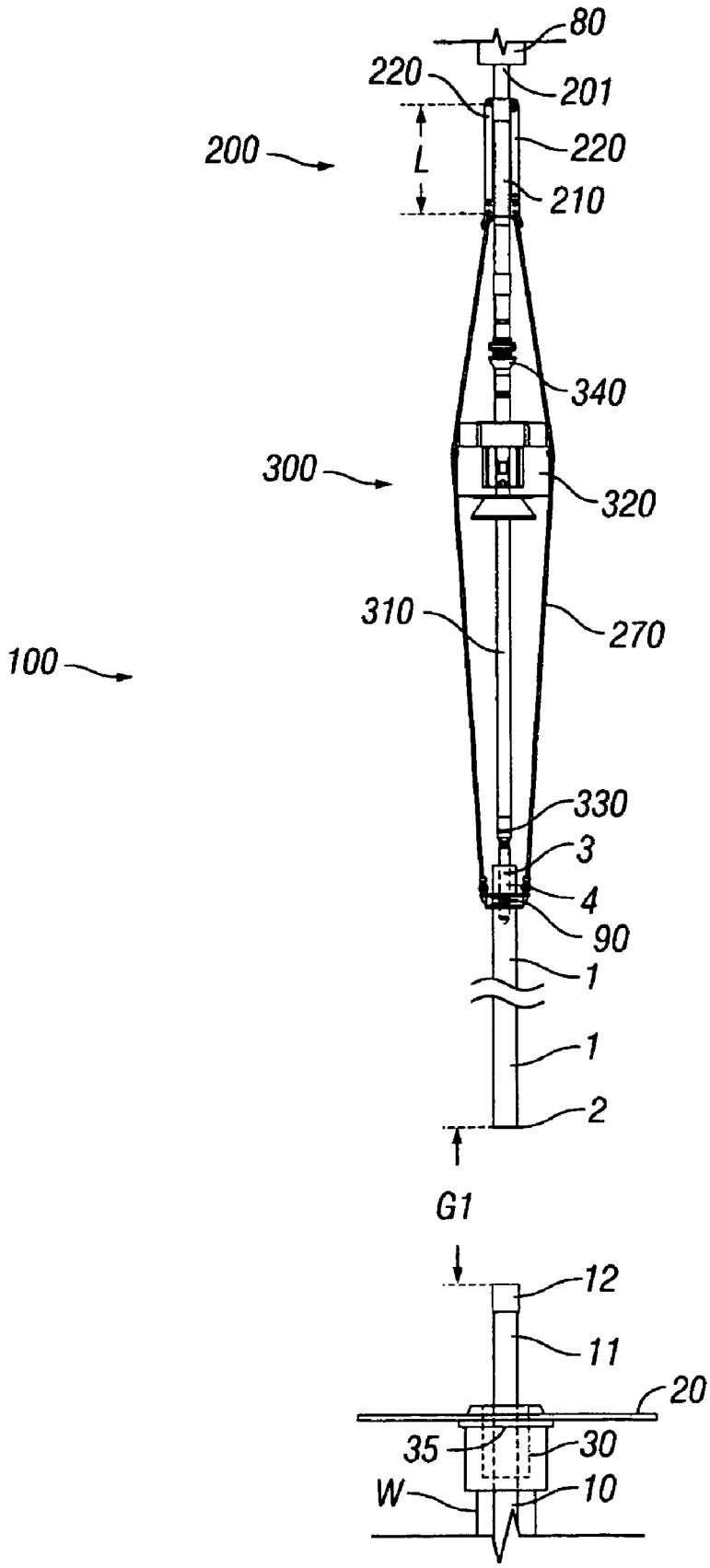
FIG. 2 shows the embodiment of FIG. 1 in which the engagement assembly is engaging the segment to be run.

As shown in FIG. 2, the actuation of the actuator assembly 200 operates to reduce gap G2 until the engagement assembly 300 engages the upper end 3 of the segment 1 to be run. For instance, actuation of the actuator apparatus 200 may cause the second member such as sleeve 220 to shorten relative to the first member or central body 210. For instance, lower arm 224 my recede within upper arm 222. As the sleeve 220 shortens, an upward force lifts the segment 1 via the sling 270 and SJE 90. Concomitantly, the central body 210 maintains its position with respect to the engagement assembly 300, thus keeping the vertical position of the engagement assembly unchanged. As the sleeve 220 continues to shorten and the segment 1 continues to raise upwardly, the gap G2 continues to be reduced. With continued shortening of the sleeve 220, the engagement assembly 200 passes into the upper end 3 of the tubular segment 1 and is received by the tubular segment 1. For instance, as shown in FIG. 2, the shortening of the second member raises the segment 1 until the mud saver valve 330 and a portion of the stinger 310 is within the upper end 3 of the segment 1, thus engaging the segment 1. It is noted that the gap G1 between the lower end of the segment 1 to be run and collar 12 on the upper end 11 of the string 10 still exists at this point, as shown in FIG. 2.

Figure 3:
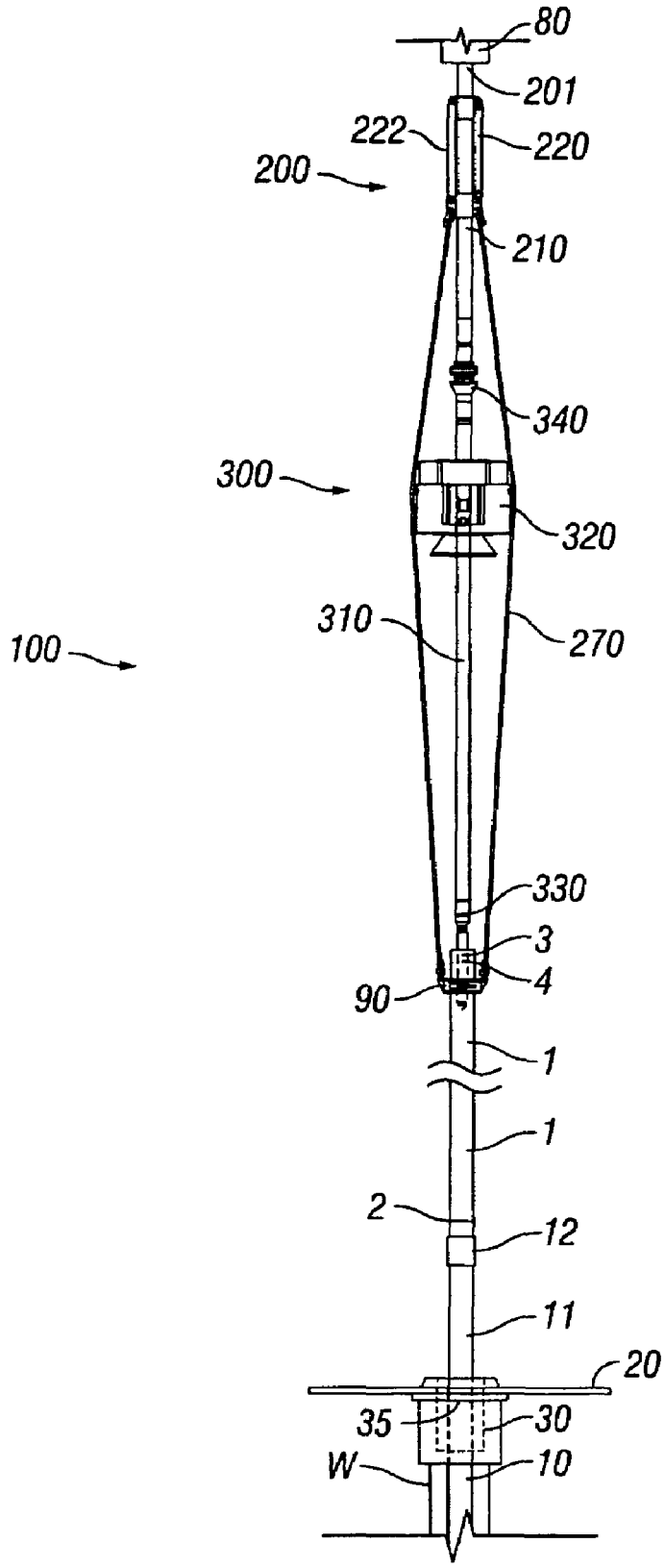
FIG. 3 shows an embodiment of the present invention in which the engagement assembly has engaged the segment, and the segment is in contact with the string in the well bore.

FIG. 2 shows the configuration after actuation of the actuator assembly 200. As shown, the engagement assembly 300 has engaged the upper end 3 of segment 1. Specifically, in the embodiment of FIG. 2, the mud saver valve 330 and a portion of the stinger 310 are within the segment 1. As described above, the mud saver valve 330 and other components shown in FIGS. 1-3 are not necessary in all embodiments. The key is that the engagement assembly 300 operates to engage and enter the upper end 3 of segment 1 to be run. This engagement provides the desired alignment of the segment 1 with the string 10 below.

Once the actuator assembly 200 is actuated and the engagement assembly 300 engages the segment 1, the segment 1 is substantially aligned with the tubular string 10 in the well bore W. Top drive assembly 80 then operates to lower the entire alignment apparatus 100 and the segment 1, to close the gap G1 between the lower end 2 of segment 1 and the upper end 11 (having a collar 12) of the tubular string 10. The top drive assembly 80 continues to lower the alignment apparatus 100 until segment 1 contacts tubular string 10, as shown in FIG. 3.

Once the lower end 2 of the segment 1 contacts the upper end 11 of the string 10, the segment 1 may be connected to the string 10 by any conventional means such as those known to one of skill in the art having the benefit of this disclosure. For instance, the lower end 2 of the segment 1 may be threaded and adapted to mate with threads in the upper end 11 (and in collar 12) of the string 10. Once the threads on lower end 2 of the segment 1 contact the threads on the upper end of the tubular string 10, the segment 1 may be rotated by a conventional tong device known to one of ordinary skill in the art. In some applications, the alignment apparatus 100 is sufficiently lowered until the connection between the lower end of the segment 1 and the string 10 is initiated or made. For instance, in some embodiments, the alignment apparatus 100 may be lowered to provide slack in the sling 270 and such that the single joint elevator SJE 90 does not interfere with the collar 4 upon rotation of the segment 1. It will be realized that the farther the engagement assembly 300 is within the segment 1, the more precise the alignment may become. Further, in some embodiments, the outer diameter of the stinger 310 may tapered, being larger at the upper end than on a lower end. For example, for running a 9⅝ inch diameter segment 1 having an inner diameter of approximately eight inches, the stinger 310 may comprise an outer diameter of five inches on a lower end, gradually increasing in diameter over the length of the stinger 310. Thus, generally, the stinger 310 may be dimensioned to provide a rattle fit with the segment 1, the segment 1 rattling around stinger 310 upon rotation of the segment 1, in some embodiments.

In other applications, the top drive assembly 80 may operate to rotate the segment 1 until a threaded connection between the segment 1 and the tubular string 10 is accomplished. Further, the segment 1 may be provided with a "snap fit" on each end, such that when a downward force is applied to the segment 1—once the segment 1 has been properly aligned with the string 10—a snap fit connection is created.

Figure 4:
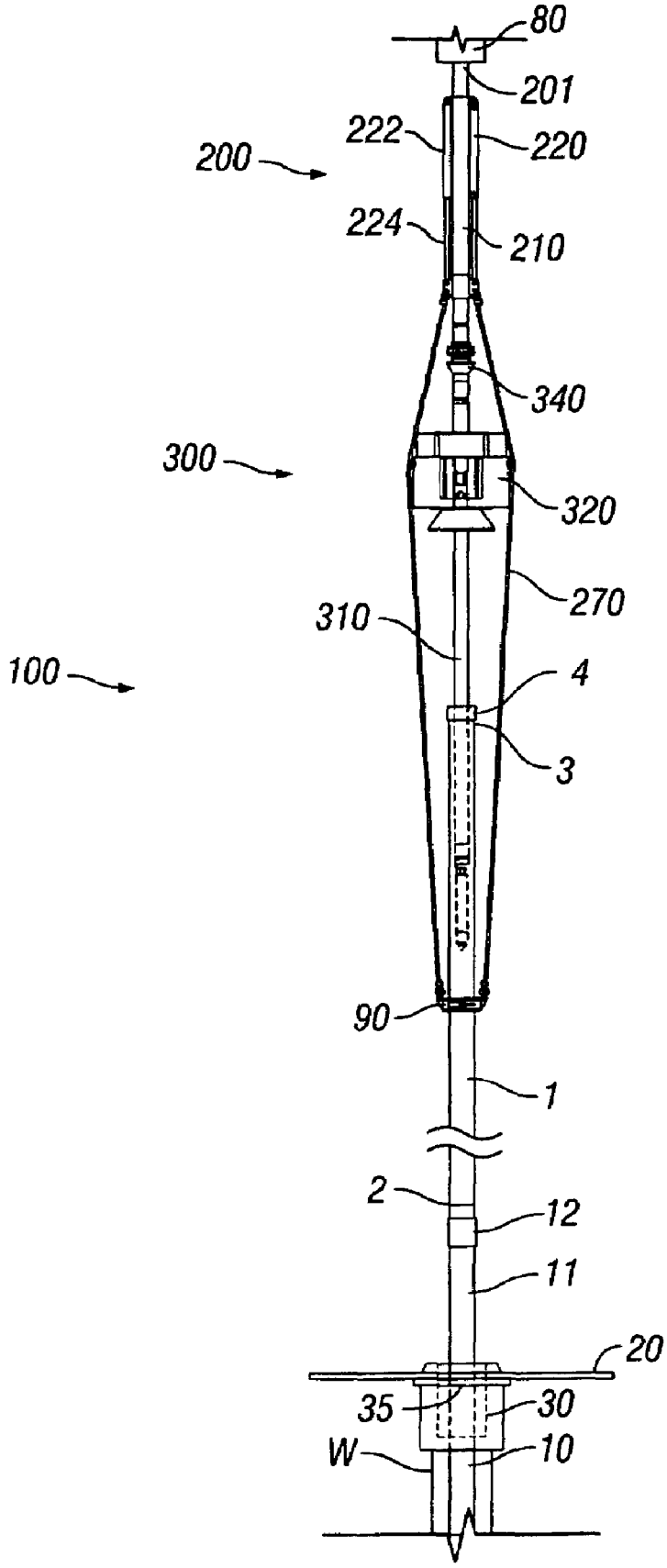
FIG. 4 shows an embodiment wherein the segment is connected to the string.

Once the segment 1 is connected to the tubular string 10, the top drive assembly 80 may further lowered, and the actuator assembly 200 may be de-activated (i.e. activated in reverse) to return to the original state. That is, the second member (e.g. sleeve 220) may return to the length of the first member (e.g. central body 210), as shown in FIG. 4.

Once lowered, the SJE 90 may be removed from the segment 1. The slips 35 of the spider 30 on the rig floor 20 may release the sting 10. The weight of the string is thus supported by the main elevator 320 of the engagement assembly 300 in this embodiment. The top drive assembly 80 then operates to lower the entire alignment apparatus 100, segment 1, and string 10 into the well bore W, until only an upper portion of segment 1 extends above the rig floor 20. At this point, the spider 30 upper portion such that slips 35 engage the segment 1 of the drill string 10, the segment 1 now within the well bore W. A new segment 1' may then be connected to the alignment apparatus via the SJE 90, and the process repeated ad seriatum.

It is noted that unlike most prior systems, the present apparatus operates to engage the inner diameter of the segment 1 being run, instead of manipulating the periphery or outer diameter of the segment 1. This provides a novel, relatively simple device for substantially aligning a segment 1 to be run with a tubular string 10 within a well bore W. Because such a system has relatively few components inter alia, the alignment apparatus 10 may be manufactured and operated in a safer manner than some prior art systems. For example, it is less likely that a spurious component from a complex machine would be dropped overhead utilizing the present apparatus in comparison to some prior art systems.

Not only does the alignment apparatus operate to eliminate the manual stabber and stabbing board of the prior art; but also the alignment apparatus may replace the use of the other relatively complex prior art jaw-type devices commercially available presently. Further, at least in part because of the reduced number of components provided with certain embodiments of the alignment apparatus and method disclosed herein, the alignment apparatus provides a more economical and safer alternative to other tools. Embodiments of the alignment apparatus therefore do not require the use of additional machinery operating overhead or the use of a rotating connection with the segment being run. Further, the simple yet versatile (i.e. may be used with tongs) design of the embodiments of the actuation assembly disclosed herein provides a dependable and relatively robust actuation method.

It is noted that the actuator assembly 200 thereby acts as means for a actuating the means for engaging, in operation. Similarly, the engagement assembly 300 acts as means for engaging the segment to be run. Further, while the illustrative embodiments of the invention have been shown, the invention contemplates the interchange of the terms "first" and "second" such that any combination of at least two members may be utilized. For example, the first member or central body 210 may be attached to the segment 1 via the sling 270, while the second member such as sleeve 220 may be attached to engagement tool 300, although a properly-designed connection therebetween would further need to be provided, as would be realized by one of ordinary skill in the art having benefit of this disclosure.

As stated above, the actuation assembly 200 is not restricted to the specific components shown in FIGS. 1-4. Any configuration, which acts to generate a relatively downward force on the engagement assembly 300 with respect to the segment 1 (i.e. relative upward force on the segment 1 with respect to the engagement assembly 300), known to one of ordinary skill in the art having the benefit of this disclosure, could be utilized. Examples are shown in FIGS. 5A-5E.

Figure 5A:
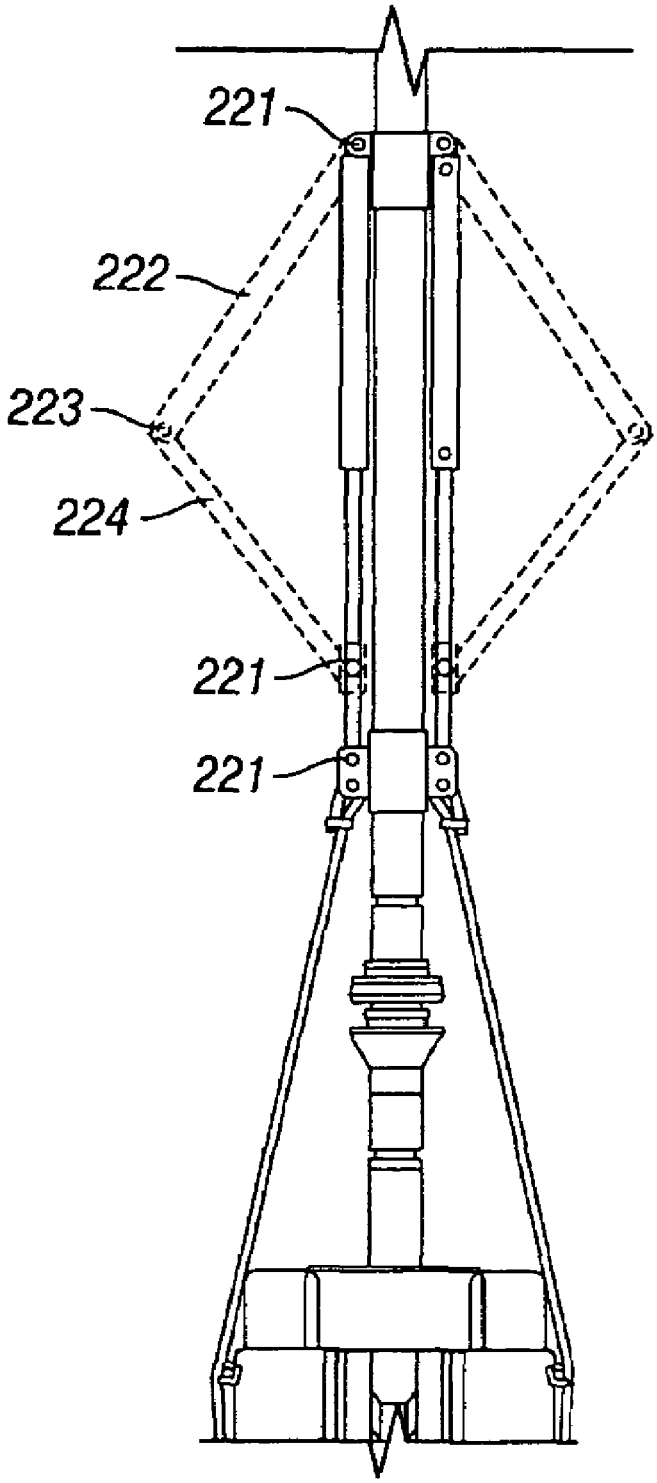
FIGS. 5A-E show alternative embodiments of an actuator assembly and engagement assembly of the present invention.

FIG. 5A shows an alternative embodiment of the actuation assembly 200 in which the first member comprises a central body 210 as described above. The solid lines represent the central body 210 and the second member in its original position. The two arms 222 and 224 described above could remain unchanged in length, but be caused to pivot about points 221 and forming an apex 223 (as shown in the dashed lines in FIG. 5A) when the actuator assembly is actuated. Thus, when pivoted, the overall vertical length of the member 220 would shorten, relative to the constant length of central body 210. Thus, the segment 1 would raise relative to the engagement assembly 300.

Figure 5B:
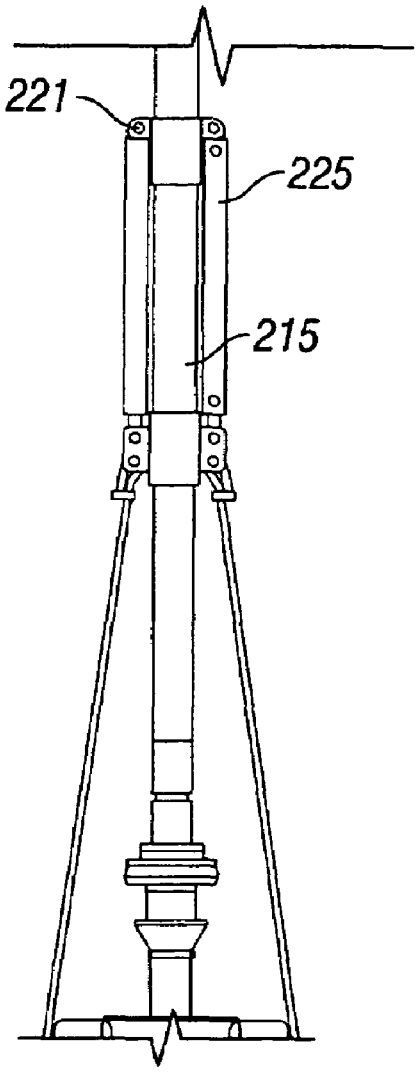
Figure 5C:
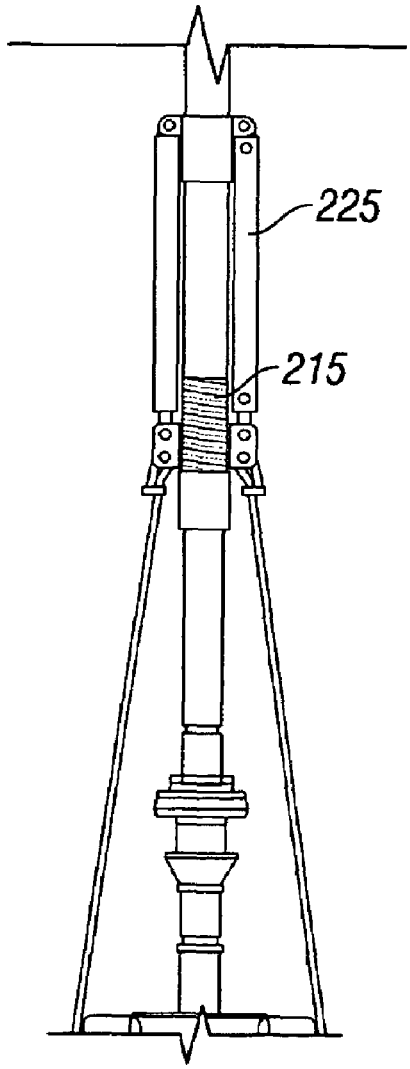

While embodiments described thus far include the second member (e.g. sleeve 220) having a changing length with respect to the first member (central body 210), the invention is not so limited. It will be understood that movement of only the second member while holding the first member stationary also falls within the term of the first member being moveable relative to the second member, as the required relative movement is provided under such a circumstance. Similarly, in some embodiments, the length of the first member may vary. For example as shown in FIGS. 5B and 5C, the first member may comprise a threaded lead screw 215, adapted to alter the overall length of the first member upon selective rotation. FIG. 5B shows the actuator assembly in its original position, comprised of lead screw 215 and solid arms 215. Upon actuation, the lead screw 215 turns to lengthen with respect to arms 225, as shown in FIG. 5C. Thus, a downward force is applied on the engagement assembly below, while the solid sleeves 225 maintain the segment 1 at a constant height. Thus, actuation of the actuator assembly operates to force the engagement assembly 300 to engage the segment 1.

Figure 5D:
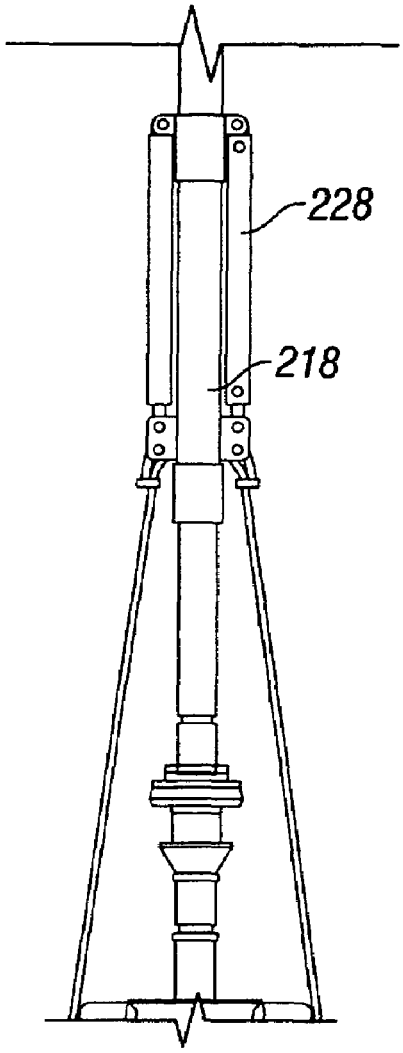
Figure 5E:
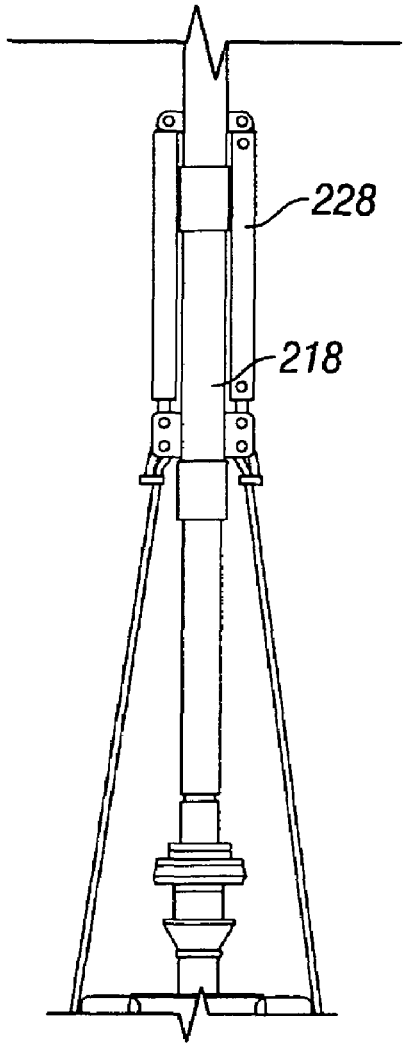

Finally, as shown in FIGS. 5D and 5E, relative movement may be provided between the first member, such as body 218, and second member, such as arms 228, via a rack and pinion arrangement with a motor, for example (not shown), with both members maintaining their original length. Upon actuation of the motor, the arms 228 move upwardly with respect to the body 218, as shown in FIG. 5E.

Thus, regardless of the actual construction thereof, upon actuation of the disclosed actuator assembly 100, an upward force is generated on the segment 1 relative to the engagement assembly (300), thus forcing the engagement assembly 300 within segment 1.

The alignment of a "segment" 1 with the "tubular string" 10 has been described. As mentioned above, the term "tubular string" may comprise a casing string, a production tubing string, or even a drill string, or any other tubular member as described above and the like. As such, the invention disclose herein is not so limited. Further, the alignment apparatus and method described herein may be utilized off-shore or at surface.

Finally, while items herein have been described as "connected" or "attached," a direct connection or attachment is not required; an indirect connection or attachment may suffice, as would be understood by one of ordinary skill in the art having the benefit of this disclosure.

Although various embodiments have been shown and described, the invention is not so limited and will be understood to include all such modifications and variations as would be apparent to one skilled in the art. Specifically, although the disclosure is described by illustrating casing segments aligned with casing strings, it should be realized that the invention is not so limited, and that the alignment apparatus and methods disclosed herein may be equally employed on drill strings, piping completing strings, and the like being run downhole.

The following table lists the description and the references designators as used herein and in the attached drawings.

| Reference Designator | Component |
|---|---|
| G1 | Initial gap between lower end 2 of segment 1 being run and upper end 11 of tubular string 10. |
| G2 | Initial gap between engagement assembly 300 and upper end 3 of segment 1. |

-continued

| Reference Designator | Component |
|---|---|
| W | Well bore |
| 1 | Tubular segment |
| 2 | Lower end of segment 1 |
| 3 | Upper end of segment 1 |
| 4 | Collar on upper end of segment 1 |
| 10 | Tubular string |
| 11 | Uppermost tubular segment of string 11 |
| 12 | Collar on upper end of uppermost segment 11 of string 10 |
| 20 | Rig floor |
| 30 | Spider |
| 35 | Slips |
| 80 | Top drive assembly |
| 90 | Single Joint Elevator (SJE) |
| 100 | Alignment Apparatus |
| 200 | Actuator assembly |
| 201 | Upper connection |
| 210 | First member |
| 212 | Lead screw central member |
| 215 | Lead Screw first member |
| 218 | Solid first member |
| 220 | Second member |
| 221 | Optional pivot point |
| 222 | Upper arm |
| 223 | Optional apex |
| 224 | Lower arm |
| 225 | Solid second member surrounding lead screw |
| 228 | Solid first member |
| 270 | Sling |
| 300 | Engagement assembly |
| 301 | Lower end of engagement assembly |
| 310 | Stinger |
| 320 | Main elevator |
| 330 | Mud saver valve |
| 340 | Fillup and circulate tool (FAC Tool) |

What is claimed is:

1. A tool for aligning a segment of casing joint to be run suspended from a top drive assembly with a casing string in a well bore, comprising:

an upper linear actuator assembly having a central body connectable to the top drive assembly, the central body being within a sleeve, the sleeve adapted to be selectively movable relative to the central body upon actuation, the sleeve functionally associated with the segment, the sleeve and the central body having a substantially similar length prior to actuation, the sleeve having a length less than a length of the central body upon actuation of the upper linear actuator, thereby moving the segment for alignment with the string; and a lower actuation assembly having an upper end connectable to the central body of the upper actuator assembly and a stinger adapted to selectively engage the segment, wherein upon actuation of the upper actuator assembly, the stinger engages the segment thereby substantially aligning the segment with the string below.

2. An apparatus for aligning a tubular segment with a tubular string in a well bore, comprising:

an actuator assembly having a first member adapted to be selectively movable relative to a second member upon actuation; and an engagement assembly being functionally associated with the actuator assembly and adapted to selectively engage the segment, wherein upon actuation of the actuator assembly, the engagement assembly engages the segment to substantially align the segment with the string, the first member being functionally associated with the engagement assembly and the second member being adapted to be functionally associated with the segment, wherein the first and second members have a substantially similar length prior to actuation, the second member having a length less than a length of the first member upon actuation thereby moving the segment toward the engagement assembly.

3. The apparatus of claim 2 wherein the first member is connectable to the engagement assembly and the second member is connectable to the segment.

4. The apparatus of claim 3, in which the first member comprises a central body and the second member comprises a sleeve round the central body, the relative movement between the sleeve and the central body upon actuation of the actuator assembly operating the engagement assembly to engage the segment.

5. The apparatus of claim 4 in which the sleeve further comprises an upper arm and a lower arm, the lower arm adapted to be withdrawn within the upper arm thereby shorting the length of the sleeve.

6. The apparatus of claim 4 in which the sleeve further comprises an upper arm and a lower arm each pivotable about a pivot and upon actuation forming an apex thereby shortening the length of the sleeve.

7. The apparatus of claim 4 in which the central member further comprises a threaded lead screw adapted to increase in length of the central member upon actuation.

8. The apparatus of claim 3 wherein the actuator assembly further comprises a linear actuator assembly.

9. The apparatus of claim 3 wherein the relative movement between the first and second member is provided by hydraulic means or pneumatic means.

10. The apparatus of claim 3 wherein the second member is connected to the segment by a single joint elevator attached to the segment, the SJE suspended from the second member by a sling.

11. The apparatus of claim 3 in which the second member further comprises a lower arm and an upper arm, pivotable about an apex upon actuation.

12. The apparatus of claim 3 wherein the engagement assembly further comprises a stinger adapted to engage the segment upon actuation of the actuator assembly.

13. The apparatus of claim 12 in which the stinger further comprises a lower end having an outer diameter less than a diameter of an upper end, the stinger being tapered therebetween.

14. The apparatus of claim 13 in which the engagement assembly further comprises a main elevator connectable to the first member of the actuator assembly, the stinger being attachable below the main elevator.

15. The apparatus of claim 12 wherein the stinger further comprises a mudsaver valve adapted to be within the segment upon actuation of the actuator assembly.

16. The apparatus of claim 15 in which the engagement assembly further comprises a fill up and circulate tool connectable between the main elevator and the first member of the actuator assembly.

17. A method of aligning a tubular segment with a tubular string in a well bore, comprising:

providing an alignment tool having a actuator assembly having first member selectively movable relative a second member upon actuation, and an engagement assembly being functionally associated with the actuator assembly and adapted to selectively engage the segment;

connecting the segment to the second member of the actuator assembly;

actuating the actuator assembly to force the engagement assembly within the segment, the first and second members having a substantially similar length prior to actuation, the second member having a length less than a length of the first member upon actuation thereby moving the segment toward the engagement assembly; and lowering the tool until the segment contacts the string.

18. The method of claim 17 in which the step of connecting further comprises connecting a single joint elevator (SJE) to the segment; and connecting the second member of the actuator assembly to the SJE via a sling.

19. The method of claim 18 wherein the engagement assembly includes a stinger for engagement within the segment.

20. The method of claim 19, further comprising:

releasing the segment from the actuator assembly; and lowering the string and the segment into the well bore.

21. The method of claim 17 in which the first member comprises a central body and the second member comprises a sleeve around the central body, the relative movement between the sleeve and the central body upon actuation of the actuator assembly operating the engagement assembly to engage the segment.

22. An apparatus for aligning a tubular segment suspended from a top drive with a tubular string in the well bore, comprising:

means for engaging the segment; and means for actuating the means for engaging the segment, the means for actuating being connected to the top drive, the means for actuating including an actuator assembly having a first member adapted to be selectively movable relative to a second member upon actuation, the first member connectable to the means for engaging, the second member connectable to the segment, the first and second members having a substantially similar length prior to actuation, the second member having a length less than a length of the first member upon actuation, thereby moving the segment toward the engagement assembly;

wherein upon actuation of the means for actuating, the means for engaging engages the segment, thereby substantially aligning the segment with the string.

23. An apparatus for aligning a tubular segment with a tubular string in a well bore, comprising:

an actuator assembly having a first member adapted to be selectively movable relative to a second member upon actuation; and an engagement assembly being functionally associated with the actuator assembly and adapted to selectively engage the segment, wherein upon actuation of the actuator assembly, the engagement assembly engages the segment to substantially align the segment with the string, the first member being functionally associated with and connectable to the engagement assembly, the second member being adapted to be functionally associated with and connectable to the segment, wherein the second member is connected to the segment by a single joint elevator attached to the segment, the SJE suspended from the second member by a sling.

24. An apparatus for aligning a tubular segment with a tubular string in a well bore, comprising:

an actuator assembly having a first member adapted to be selectively movable relative to a second member upon actuation; and an engagement assembly being functionally associated with the actuator assembly and adapted to selectively engage the segment, wherein upon actuation of the actuator assembly, the engagement assembly engages the segment to substantially align the segment with the string, the first member being functionally associated with and connectable to the engagement assembly, the second member being adapted to be functionally associated with and connectable to the segment, in which the second member further comprises a lower arm and an upper arm, pivotable about an apex upon actuation.

25. An apparatus for aligning a tubular segment with a tubular string in a well bore, comprising:

an actuator assembly having a first member adapted to be selectively movable relative to a second member upon actuation; and an engagement assembly being functionally associated with the actuator assembly and adapted to selectively engage the segment, wherein upon actuation of the actuator assembly, the engagement assembly engages the segment to substantially align the segment with the string, the first member being functionally associated with and connectable to the engagement assembly, the second member being adapted to be functionally associated with and connectable to the segment, wherein the engagement assembly further comprises a stinger adapted to engage the segment upon actuation of the actuator assembly, the stinger having a lower end with an outer diameter less than a diameter of an upper end, the stinger being tapered therebetween, the engagement assembly having a main elevator connectable to the first member of the actuator assembly, the stinger being attachable below the main elevator.

* * * * *

UNITED STATES PATENT AND TRADEMARK OFFICE

CERTIFICATE OF CORRECTION

PATENT NO. : 7,296,632 B2
APPLICATION NO. : 11/103132
DATED : November 20, 2007
INVENTOR(S) : Stewart John Barker et al.

It is certified that error appears in the above-identified patent and that said Letters Patent is hereby corrected as shown below:

Claim 4, Column 11, line 14, delete “round” and insert --around--.

Signed and Sealed this

Fifteenth Day of April, 2008

JON W. DUDAS
*Director of the United States Patent and Trademark Office*